US006926397B2

(12) United States Patent
Ward et al.

(10) Patent No.: US 6,926,397 B2
(45) Date of Patent: Aug. 9, 2005

(54) CARTRIDGE TAPE REMOVAL APPARATUS AND METHOD

(75) Inventors: Jefferson P Ward, Brush Prairie, WA (US); Erik D Ness, Vancouver, WA (US); Teresa M Cray, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 90 days.

(21) Appl. No.: 10/424,832

(22) Filed: Apr. 29, 2003

(65) Prior Publication Data

US 2004/0218023 A1 Nov. 4, 2004

(51) Int. Cl.[7] ..... B41J 2/175
(52) U.S. Cl. ..... 347/86
(58) Field of Search ..... 347/86, 84, 85, 347/87, 100, 47, 50, 29, 22, 44

(56) References Cited

U.S. PATENT DOCUMENTS 5,414,454 A * 5/1995 Reid ..... 347/29
5,966,156 A * 10/1999 Scheffelin et al. ..... 347/86
6,161,915 A 12/2000 Bolash et al.
6,260,942 B1 7/2001 Ahne et al.
6,634,732 B2 * 10/2003 Farr et al. ..... 347/29

* cited by examiner

*Primary Examiner*—K. Feggins

(57) ABSTRACT

A nozzle tape covers substantially all of an outlet portion and an electrical contact portion of a print cartridge. At least one hole provided in the portion of the nozzle tape covering substantially all of the electrical contact portion exposes at least one electrical contact formed on the electrical contact portion. When the cartridge is installed in a print device, such as a printer, a partial electrical connection will be established between the exposed electrical contact and a corresponding electrical contact in the print device. The partial electrical connection may be used to convey a signal to an output device, such as a computer. The signal may indicate that the nozzle tape must be removed before the print cartridge will work properly.

16 Claims, 6 Drawing Sheets

CARTRIDGE TAPE REMOVAL APPARATUS AND METHOD

BACKGROUND

For a variety of reasons, consumers have had great difficulty in recognizing that nozzle tape must be removed prior to inserting an ink cartridge into a print device such as, for example, a printer, photocopier, etc. Nozzle tape is designed to cover the orifice region (also referred to as an "outlet portion") of a print cartridge temporarily, thereby decreasing the rate of evaporation of the ink in the cartridge, when the cartridge is being stored or transported prior to first use. The nozzle tape also serves to protect the printhead.

A number of methods have been tried to make the nozzle tape more visible to the consumer and/or to educate the consumer about the need to remove the tape prior to first use. For example, some cartridge manufactures have added costly color to the nozzle tape to make it more readily visible. By way of another example, rigid, colorful tags having icons and/or words thereon have also been added to the cartridge. These tags often fall-off during storage or shipping. In addition, consumers often do not understand the meaning of the icons and/or words printed on the tags and, therefore, fail to heed their instructions. Finally, documentation detailing the removal of the nozzle tape prior to first use has been provided with the cartridge. Similarly, diagrams showing the removal of the nozzle tape have been provided on the print device and/or on the carton containing the cartridge.

Unfortunately, all of these methods have proven unsuccessful in eliminating the problem and, therefore, many consumers remain unaware or forget to remove the nozzle tape prior to inserting a new print cartridge into a print device. Moreover, the consumer is unaware as to why the new print cartridge fails to produce any ink. These consumers often wind-up: (a) calling the print device and/or cartridge manufacturer assistance line; or (b) returning the cartridge. As a result, the consumer experiences costly downtime and frustration. In addition, assistance calls to the cartridge and print device manufacturers regarding this frequent problem require the manufacturers to hire additional service technicians. The cost associated with employing these additional service technicians is passed-on to the consumer by way of higher prices for cartridges and print devices.

Accordingly, what is needed is a nozzle tape apparatus that enables a consumer to understand that the nozzle tape must be removed prior to first use.

SUMMARY

One embodiment of the invention address a print cartridge which includes: an electrical contact portion having a plurality of electrical contacts thereon; an outlet portion adapted to dispense a substance housed within the cartridge; and a nozzle tape. In this embodiment; a first portion of the nozzle tape removably covers substantially all of the outlet portion whereas a second portion of the nozzle tape removably covers substantially all of the electrical contact portion. In addition, at least one hole through the portion of the nozzle tape covering substantially all of the electrical contact portion is aligned with at least one of the electrical contacts.

The invention also contemplates an analytical apparatus which includes: an output device; a print cartridge; and a print device electrically connected to the output device and which is adapted to receive the print cartridge. In this embodiment, the print cartridge includes an electrical contact portion having a plurality of electrical contacts thereon, an outlet portion adapted to dispense a substance housed within the cartridge, and a nozzle tape. A first portion of the nozzle tape removably covers substantially all of the outlet portion whereas a second portion of the nozzle tape removably covers substantially all of the electrical contact portion. At least one hole through the portion of the nozzle tape covering substantially all of the electrical contact portion is aligned with at least one of the electrical contacts.

The invention also contemplates a method which includes the steps of: providing a print cartridge, wherein the print cartridge comprises a nozzle tape which covers substantially all of an outlet portion and an electrical contact portion, and wherein at least one hole in the nozzle tape is aligned with at least one electrical contact provided in the electrical contact portion; inserting the print cartridge into a print device; establishing an electrical connection between the electrical contact in the electrical contact portion of the print cartridge which is aligned with the at least one hole with a corresponding electrical contact provided in the print device; creating an electrical signal in response to the electrical connection between the electrical contact on the print cartridge and the corresponding electrical contact provided in the print device indicating that the tape must be removed; and transmitting the signal to an output device.

These and other features, aspects, and advantages of the present invention will become more apparent from the following description, appended claims, and accompanying exemplary embodiments shown in the drawings.

DETAILED DESCRIPTION

Figure 1:
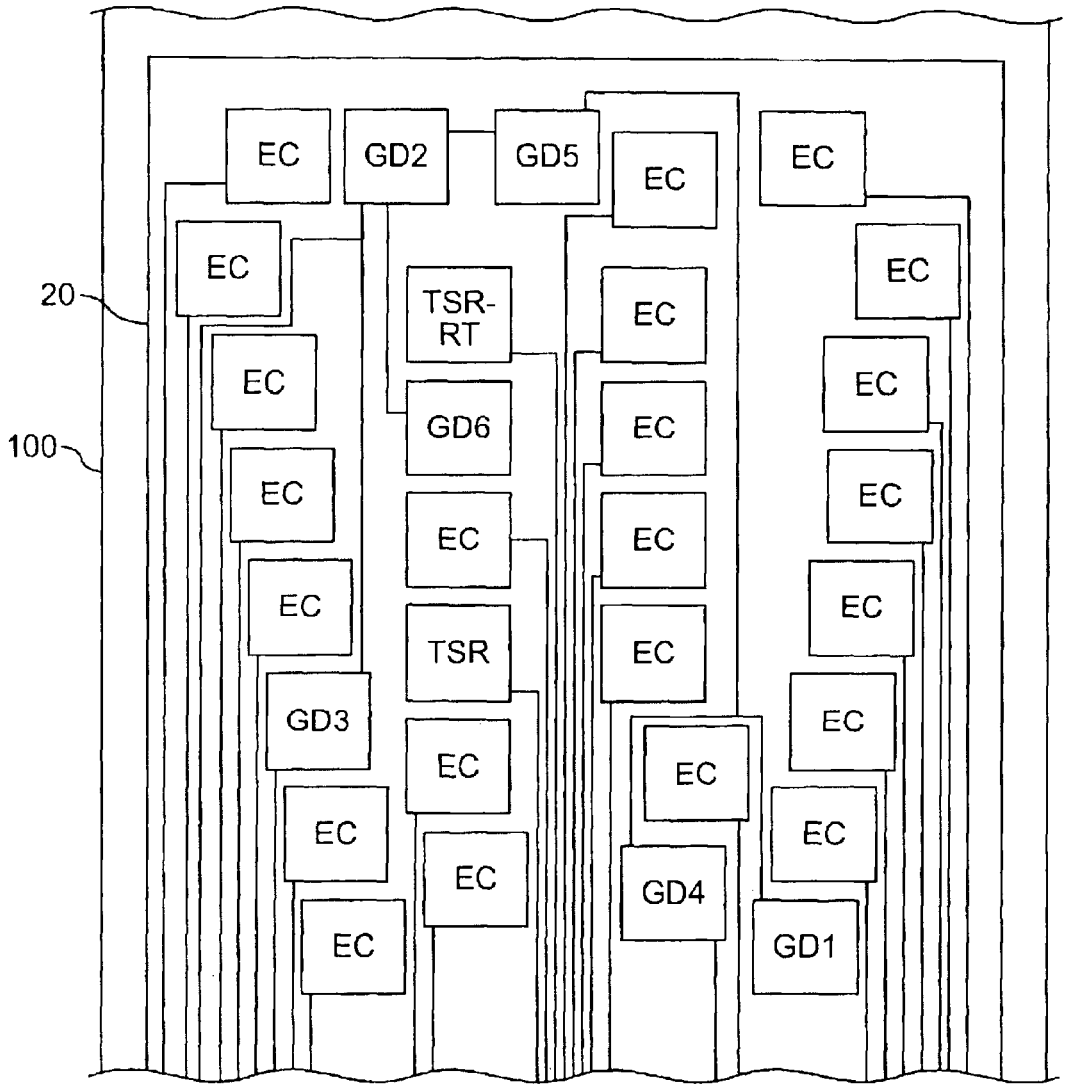
FIG. 1 is a breakaway end view of an electrical contact portion of an exemplary inverted print cartridge in accordance with an embodiment of the present invention.

Reference will now be made in detail to presently preferred embodiments of the invention, which are illustrated in the drawings. An effort has been made to use the same reference numbers throughout the drawings to refer to the same or like parts.

FIG. 1 shows an end view of an electrical contact portion 20 of an exemplary inverted print cartridge 100. The electrical contact portion 20 contains a plurality of electrical pads (also referred to as "electrical contacts") each of which has a corresponding designation. For example, the electrical contacts may be arranged as shown in FIG. 1 in an arrangement known to exist on an exemplary Hewlett-Packard Company printhead. However, the invention is not limited to this printhead shown in FIG. 1. Rather, the invention is applicable to a plurality of printheads and cartridges including color inkjet print cartridges, black inkjet cartridges, and other cartridges/printheads.

In this embodiment, there are a plurality of Ground electrical contacts GD1, GD2, GD3, GD4, GD5, GD6. In addition, there is a plurality of other electrical contacts EC, each of which is separately controlled via a conductor such as a wire. The electrical contacts EC may be Select, Data Line, C-Sync, Identification, and/or Fire Line contacts. In addition, there are two other electrical contacts a Thermal Sense Resistor ("TSR") electrical contact and a Thermal Sense Resistor Return ("TSR-RT") electrical contact.

The TSR is a resistive trace on the die of known magnitude. The trace resistance varies with temperature. An indication of the printhead temperature can allow a print device 70 to detect printhead failures, or to adjust the print device's operation to avoid failures and to optimize print quality. The value of the resistance can be measured and the temperature of the print cartridge inferred by measurement with an A/D converter using techniques known in the industry. The TSR and TSR-RT electrical contacts are connected to a resistor of known value. If a print device 70 sees this load across these two contacts it can infer there is a print cartridge present.

If the TSR and TSR-RT electrical contacts are electrically connected to corresponding electrical contacts in a print device 70 (e.g., a photocopier, a printer, such as for example, an inkjet printer, a LaserJet printer, etc.) whereas the remaining electrical contacts EC on the electrical contact portion 20 are insulated, an error message may be generated, as later described in detail.

Figure 2:
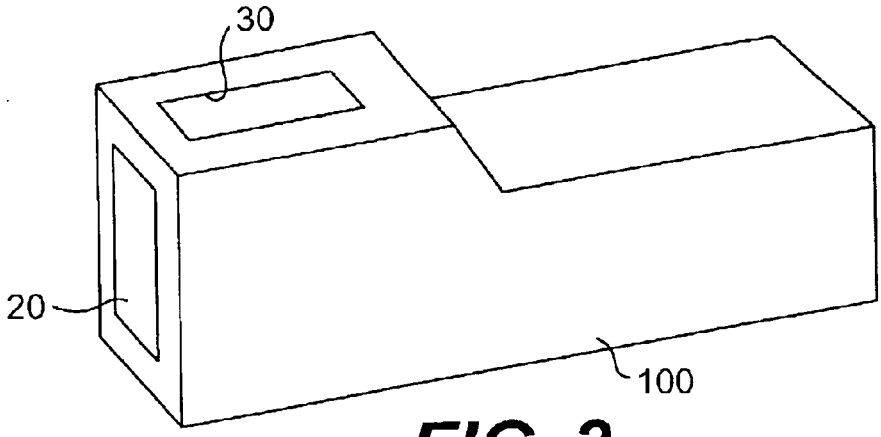
FIG. 2 is perspective view of the exemplary print cartridge of FIG. 1 showing an outlet portion and the electrical contact portion.

The electrical contact portion 20 is located on an end of the print cartridge 100, as shown in FIG. 2, which shows the print cartridge 100 in an inverted state. On a lateral side of the print cartridge 100, there is a provided an outlet portion 30 through which a substance (e.g., inkjet ink, toner, etc.) may exit. Although not shown, the outlet portion 30 may be formed of two or more nozzles (or groups of nozzles) each of which is adapted to dispense a different substance. For example, the outlet portion 30 may comprise three nozzles (or groups of nozzles) each of which is adapted to dispense a different substance (e.g., cyan ink, magenta ink, and yellow ink). In use, and as later shown in FIGS. 5 and 6, the print cartridge 100 may be oriented in a non-inverted state so that gravity will aid in the dispensing of the substance(s) held in the print cartridge 100 through the outlet portion 30.

Figure 3:
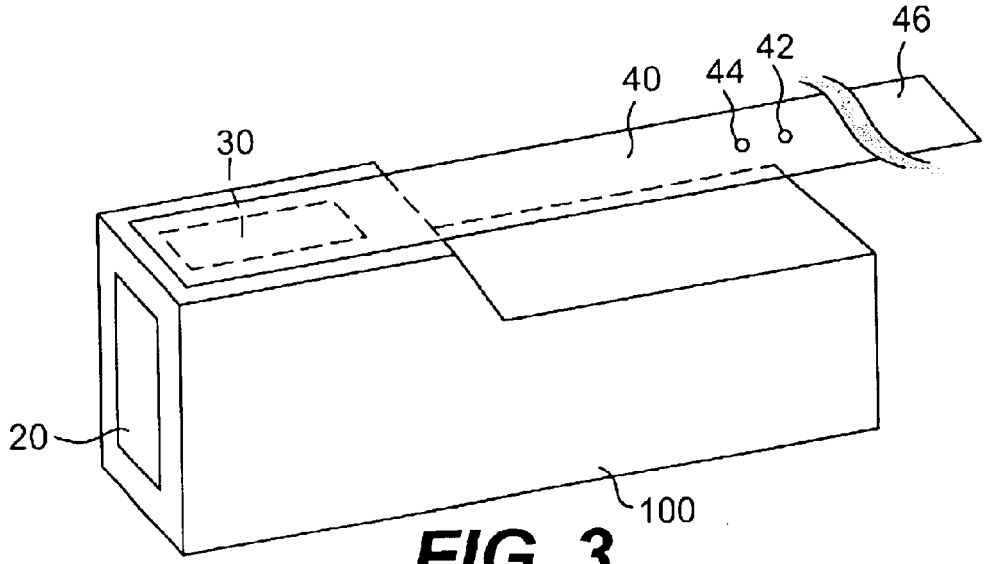
FIG. 3 is a perspective view of the exemplary print cartridge of FIG. 2 in which a nozzle tape has been affixed to cover the outlet portion.
Figure 4:
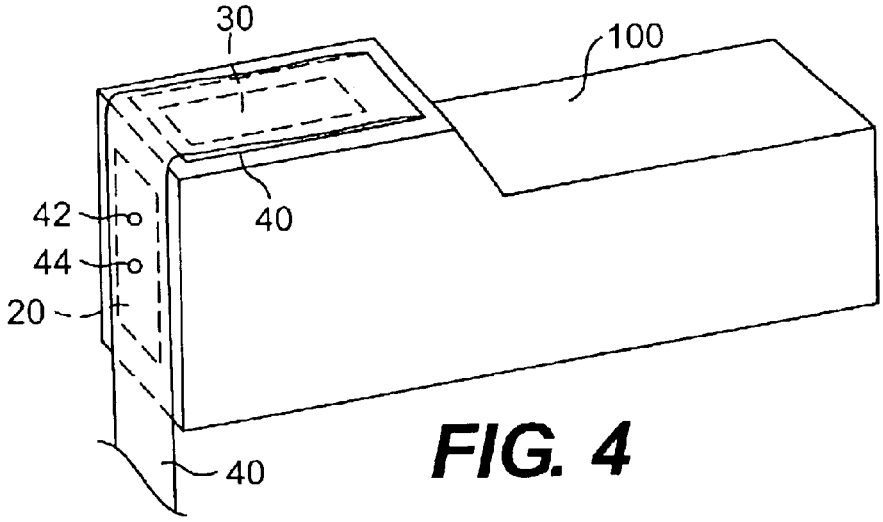
FIG. 4 is a perspective view of the exemplary print cartridge of FIG. 3 wherein the nozzle tape has been folded to cover the electrical contact portion.

To decrease the evaporation rate of the substance(s) housed in the print cartridge 100, nozzle tape 40 is affixed to the cartridge 100 to cover the outlet portion 30 substantially, as shown in FIG. 3; the nozzle tape is affixed using a weak adhesive. The nozzle tape 40 is then folded toward the end of the cartridge 100 having the electrical contact portion 20 thereon, as shown in FIG. 4. Subsequently, as shown in FIG. 5, the cartridge 100 may be inserted into a carrier 50 (if one is used in conjunction with the print device 70) so that the outlet portion 30 (not shown) is oriented downward and the nozzle tape 40 is accessible outside of the carrier 50.

Figure 5:
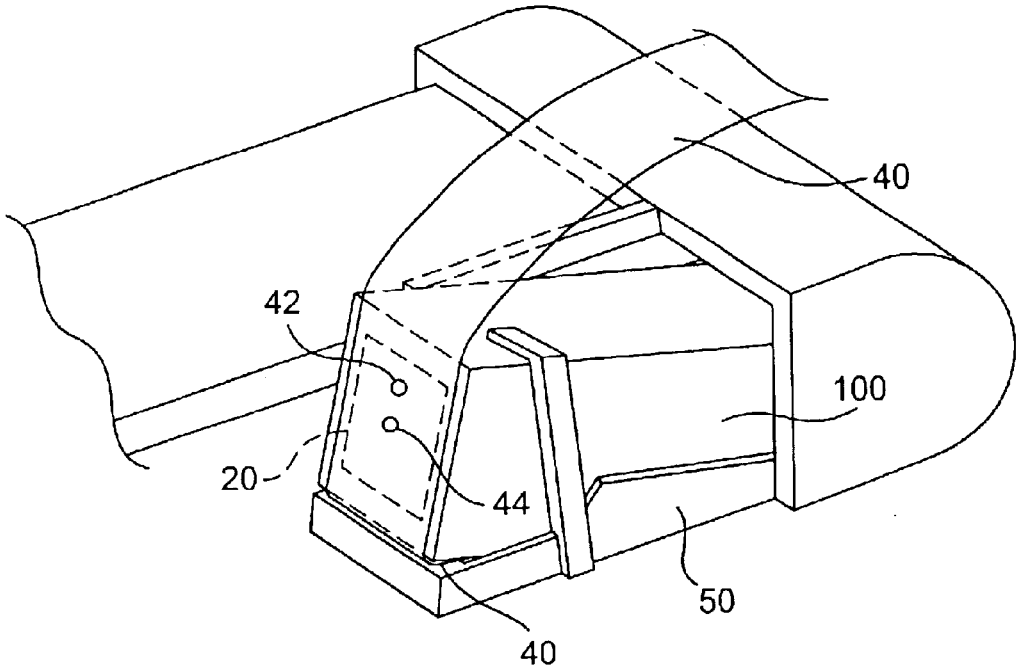
FIG. 5 is a perspective view of the exemplary print cartridge of FIG. 4 in a non-inverted state, the print cartridge being inserted into a carrier which is adapted, in turn, to be inserted into a print device.
Figure 6:
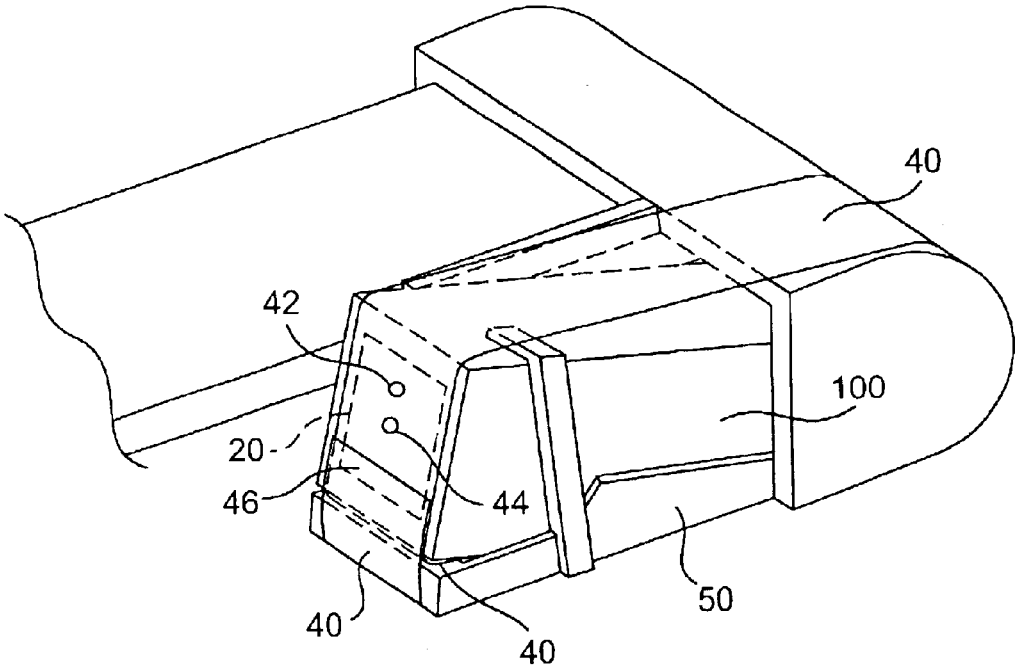
FIG. 6 is a perspective view of the carrier and exemplary print cartridge of FIG. 5 in which the nozzle tape has been wrapped around the carrier and affixed to itself.
Figure 7:
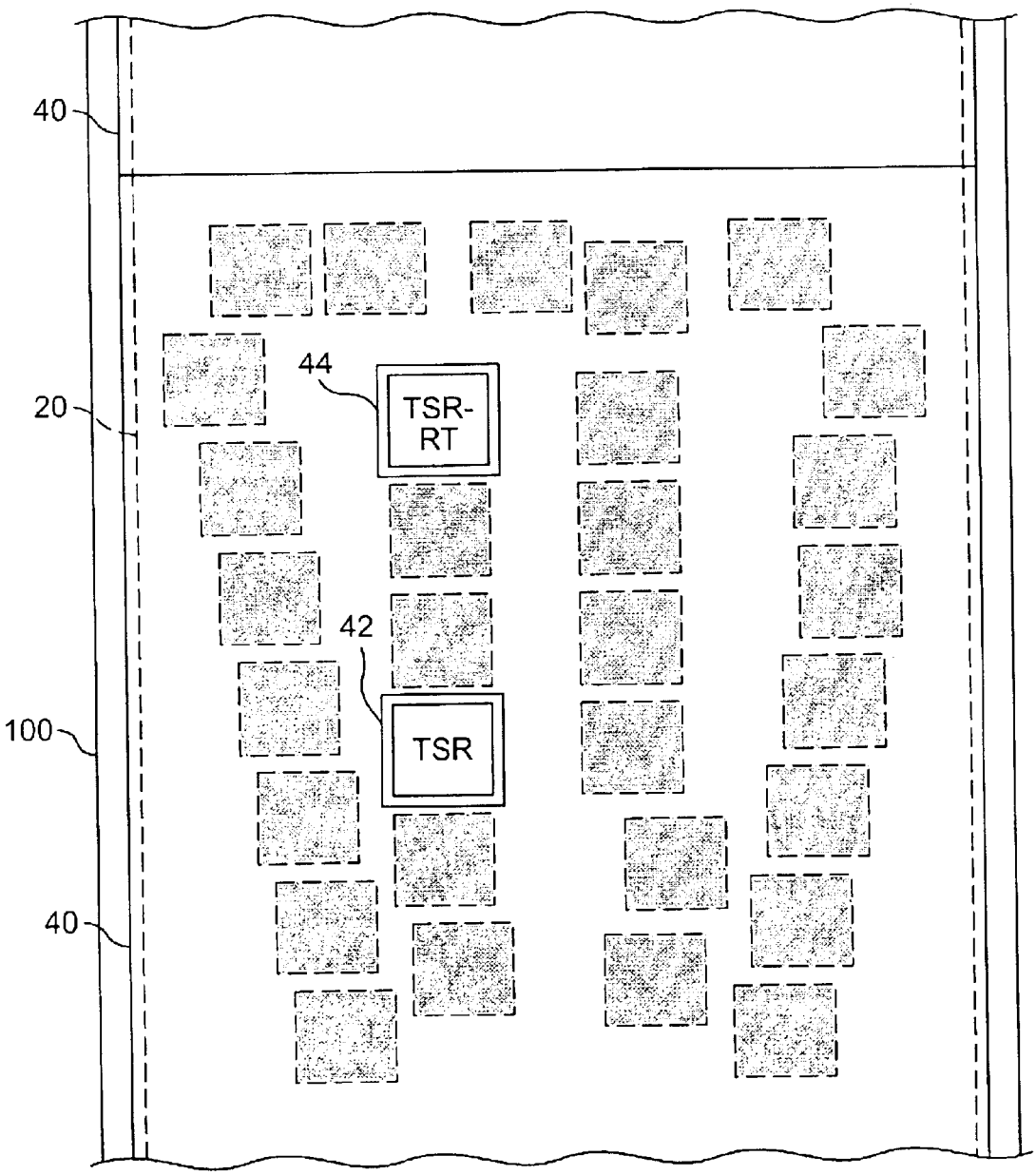
FIG. 7 is an end view of the exemplary print cartridge of FIG. 6 showing that the nozzle tape covers substantially all of the electrical contact portion except at least two electrical contacts which are exposed via holes in the nozzle tape.

At this point, the nozzle tape 40 is pulled over the end of the print cartridge having the electrical contact portion 20 thereby substantially covering the electrical contact portion 20, as shown in FIGS. 5–7. Further, the nozzle tape 40 is affixed to the electrical contact portion 20 using a weak adhesive. In addition, as the nozzle tape 40 acts as an insulator, it prevents electrical contact between any of the covered electrical contacts EC and a corresponding electrical contacts in a device, such as for example, a print device 70 (shown in FIG. 8). Further, after the nozzle tape 40 passes the electrical contact portion 20, the tape 40 is wrapped around the cartridge 100, as shown in FIG. 6, and affixed either to a surface of the print cartridges or to itself at a distal end 46 thereof using an adhesive.

Figure 8:
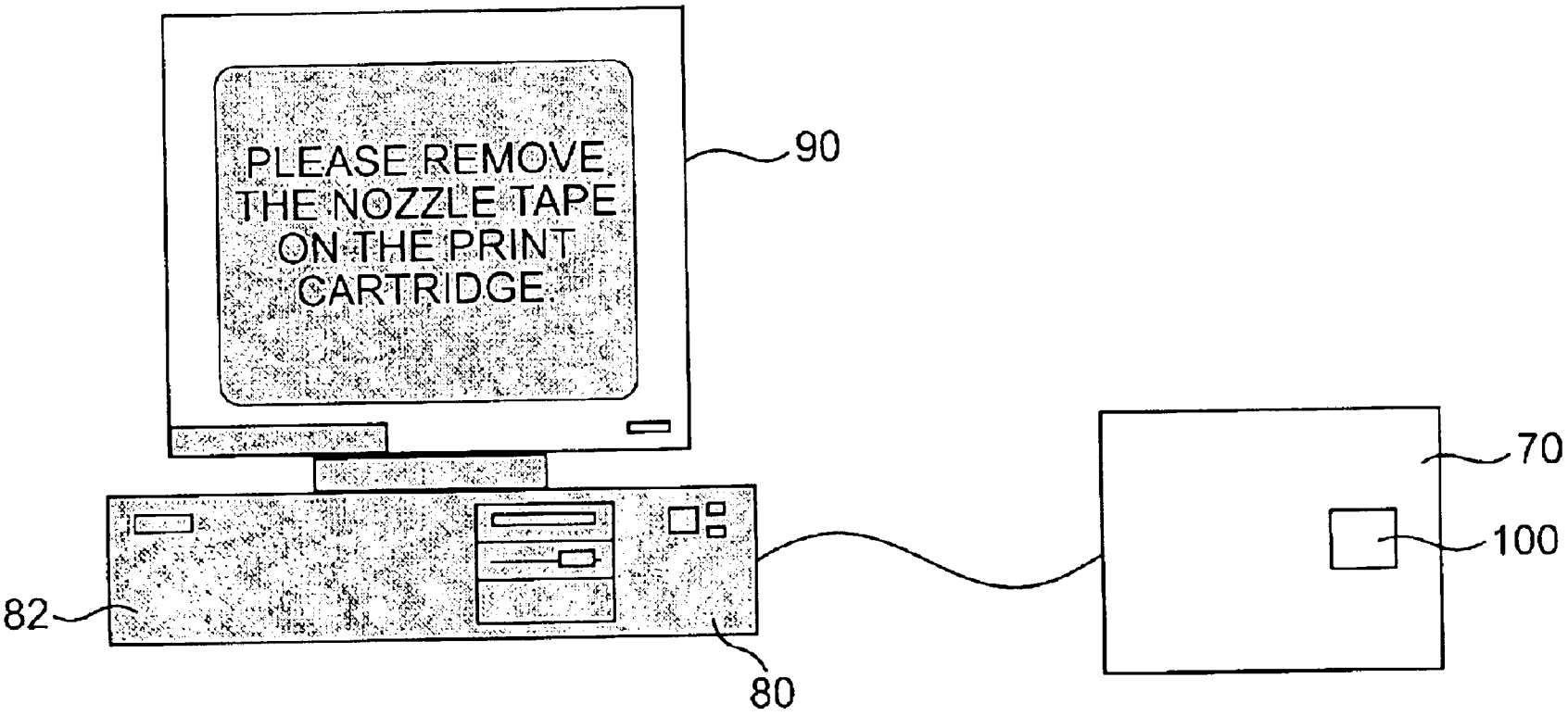
FIG. 8 is a schematic diagram of a computer, attached to a print device, which includes a monitor which is adapted to display an image indicating that the nozzle tape: (a) must be removed before the print cartridge will function properly; or (b) has been properly removed.

As previously mentioned if the TSR and TSR-RT electrical contacts are exposed whereas the remaining electrical contacts EC are insulated, an error message may be generated when the print cartridge 100 is loaded in a print device 70, as shown in FIG. 8. Accordingly, as shown in FIG. 7, holes 42, 44 are provided in the nozzle tape 40 to expose the TSR and TSR-RT electrical contacts. As a result, if the cartridge 100 is loaded into a print device 70 with the nozzle tape 40 thereon, the TSR and TSR-RT electrical contacts will be adapted to make electrical connections with corresponding electrical contacts in the print device 70, whereas the remaining electrical contacts EC will be insulated from electrical connectivity by the nozzle tape 40.

The print device 70 will be able to recognize resistance between the TSR and TSR-RT electrical contacts and the corresponding electrical contacts in the print device 70; the resistance may indicate limited electrical connectivity between the print cartridge 100 and the print device 70. In response to this limited electrical connectivity, the print device 70 may send a signal to an output device 80 (e.g., a computer) indicating that the nozzle tape 40 needs to be removed, as later described in detail.

FIG. 8 is a schematic diagram of an output device 80, in the exemplary form of a computer, which is attached to a print device 70. The output device 80 includes a monitor 90 and a central processing unit ("CPU") 82. When the print device 70 determines that the nozzle tape 40 remains on the electrical contact portion 20 of the print cartridge 100 (by means of the limited electrical connections between only the TSR and TSR-RT electrical contacts on the cartridge 100 and corresponding electrical contacts provided in the print device 70), a signal may be sent to the CPU 82. The CPU may interpret the signal and directs an error message to be displayed on the monitor 90. For example, the monitor may display an image which says, "PLEASE REMOVE THE NOZZLE TAPE ON THE PRINT CARTRIDGE." Moreover, the monitor may display a video showing how to remove the nozzle tape 40.

Figure 9:
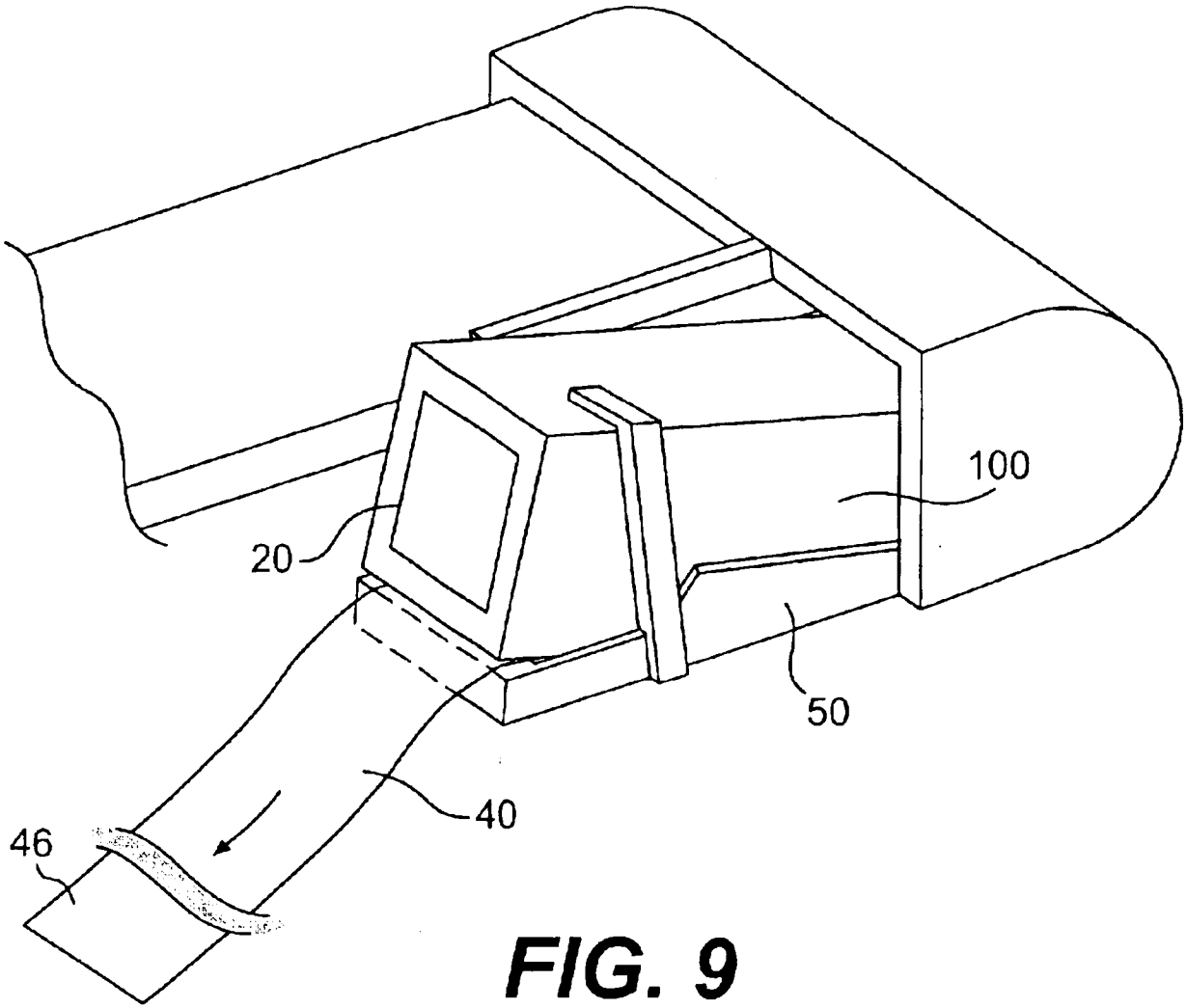
FIG. 9 is perspective view of the exemplary print cartridge of FIGS. 5 and 6 in which the nozzle tape is being removed by pulling on an accessible end thereof.

In response to the error message displayed on the monitor 90, the consumer can open the print device 70, remove the print cartridge 100 (including the carrier 50 if one is provided), and remove the nozzle tape 40 by pulling on an accessible distal end 46 thereof, as shown in FIG. 9. Further, the accessible end 46 may be exposed (as shown).

After the nozzle tape 40 is removed and the print cartridge 100 replaced in the print device 70, additional electrical connections may be made between at least some of the remaining electrical contacts EC on the electrical contact portion 20 and corresponding electrical contacts provided in the print device 70. In response to these additional electrical connections, an additional signal may be sent by the print device 70 to the output device 80 indicating that the print cartridge 100 has been properly installed. Further, in response to this additional signal, if a computer is used for the output device 80, the CPU 82 may send a signal to the monitor 90 to display a non-error message. For example, the non-error message may say, "THE PRINT CARTRIDGE HAS BEEN PROPERLY INSTALLED."

It should be recognized that if the print device 70 has a plurality of cartridge chutes, an error message of the type previously discussed may not be displayed if one or more of the chutes does not have a cartridge 100 therein provided the print device 70 can function using one print cartridge 100 in one chute, i.e., an error message need not be displayed merely because one or more of the other chutes lacks a cartridge 100. In this manner, the device 70 may be able to differentiate between empty chutes and chutes having cartridges 100 therein which have nozzle tape 40 thereon.

One or more of the following benefits may arise from invention described herein: (a) increased design flexibility for the nozzle tape; (b) less expense in manufacturing the nozzle tape: (c) a reduction in documentation and the confusion it causes; (d) an accurate way to detect and to notify consumers that the nozzle tape 40 must be removed from the print device 70, thereby reducing consumer frustration and support costs; and (e) a nozzle tape which is easy to manufacture and which is robust in design.

Although the aforementioned describes embodiments of the invention, the invention is not so restricted. It will be apparent to those skilled in the art that various modifications and variations can be made to the disclosed embodiments of the present invention without departing from the scope or spirit of the invention. For example, like the colored nozzle tape of the prior art, the nozzle tape used herein may also be brightly colored and/or have instructions or icons printed thereon.

By way of further example, although the TSR and TSR-RT pads are unique to the exemplary printhead shown in FIG. 1, similar electrical contacts are provided on all other print cartridges/printheads; in some cases, these alternative printheads include Acumen data chips. By way of another further example, although the aforementioned described sensing a resistance using the TSR and TSR-RT contacts, the invention could work by sensing another measurable quantity such as, for example, inductance, capacitance, impedance, etc. Moreover, the invention could work equally well sensing an electrical connection between one electrical contact of the cartridge 100 and a corresponding electrical contact in a print device 70 whereas the remain electrical contacts of the cartridge 100 remain insulated by the nozzle tape 40.

By way of another further example, although the output device 80 is described as being separate from the print device 70, this is not necessary, i.e., the output device 80 could be part of the print device 70. Moreover, although the output device 80 is described as being a computer, this is also unnecessary. For example, the output device could be a light emitting diode ("LED"), liquid crystal display ("LCD"), audio device (e.g., a speaker), etc. The LED or LCD could be illuminated to indicate the presence of the nozzle tape. Similarly, an audible sound (e.g., beep or words) could be emanated through a speaker. Further, such an alternative output device could be formed on an exterior surface of the print device.

Accordingly, these other print cartridges/printheads would benefit from the same nozzle tape apparatus and method described herein and, therefore, are fully within the scope of the claimed invention. Therefore, it should be understood that the apparatus and method described herein are illustrative only and are not limiting upon the scope of the invention, which is indicated by the following claims.

What is claimed is:

1. A print cartridge comprising:

an electrical contact portion having a plurality of electrical contacts thereon;

an outlet portion adapted to dispense a substance housed within the cartridge; and a nozzle tape, wherein a first portion of the nozzle tape removably covers substantially all of the outlet portion, wherein a second portion of the nozzle tape removably covers substantially all of the electrical contact portion, and wherein at least one hole through the portion of the nozzle tape covering substantially all of the electrical contact portion is aligned with at least one of the electrical contacts.

2. The print cartridge according to claim 1, wherein if the cartridge is loaded into a print device with the nozzle tape covering substantially all of the electrical contact portion, an electrical connection will be established between the at least one electrical contact aligned with the hole in the nozzle tape and a corresponding electrical contact provided in the print device.

3. The print cartridge according to claim 2, wherein the print device is an inkjet printer, LaserJet printer, or photocopier.

4. The print cartridge according to claim 2, wherein after the cartridge is loaded into the print device, the nozzle tape is adapted to be removed by removing the cartridge from the print device and pulling on an accessible end of the nozzle tape.

5. The print cartridge according to claim 1, wherein the substance is ink or toner.

6. The print cartridge according to claim 1, wherein the print device senses a measurable quantity caused by the electrical connection established between the at least one electrical contact aligned with the hole in the nozzle tape and a corresponding electrical contact provided in the print device.

7. The print cartridge according to claim 6, wherein the measurable quantity is selected from the group consisting of resistance, inductance, capacitance, and impedance.

8. A cartridge comprising:

an electrical contact portion having a plurality of electrical contacts thereon;

an outlet portion adapted to dispense a substance housed within the cartridge; and a nozzle tape, wherein a first portion of the nozzle tape removably covers substantially all of the outlet portion, wherein a second portion of the nozzle tape removably covers substantially all of the electrical contact portion, and wherein at least one hole through the portion of the nozzle tape covering substantially all of the electrical contact portion is aligned with at least one of the electrical contacts, wherein if the cartridge is loaded into a print device with the nozzle tape covering substantially all of the electrical contact portion, an electrical connection will be established between the at least one electrical contact aligned with the hole in the nozzle tape and a corresponding electrical contact provided in the print device, wherein the electrical connection between the electrical contact on the cartridge which is aligned with the at least one hole and the corresponding electrical contact provided in the print device is configured to initiate a first electrical signal to an output device, and wherein the first electrical signal is adapted to indicate that the nozzle tape covers substantially all of the electrical contact portion.

9. The print cartridge according to claim 8, wherein in response to the signal, the nozzle tape is positioned be removed by pulling on an accessible end thereof, wherein after the nozzle tape is removed additional electrical connections will be established between at least some of the remaining the electrical contacts on the print cartridge and corresponding electrical contacts provided in the print device, and wherein the additional electrical connections are adapted to send additional electrical signals to the output device.

10. The print cartridge according to claim 9, wherein at least one of the additional electrical signals indicates that the nozzle tape does not cover the electrical contact portion.

11. The print cartridge according to claim 10, wherein the print device is an inkjet printer, LaserJet printer, or photocopier.

12. The print cartridge according to claim 10, wherein the output device is a computer, LED, LCD, or audible device.

13. The print cartridge according to claim 8, wherein the output device is part of the print device.

14. An analytical apparatus comprising:

an output device;

a print cartridge comprising:

an electrical contact portion having a plurality of electrical contacts thereon;

an outlet portion adapted to dispense a substance housed within the cartridge; and a nozzle tape, and a print device electrically connected to the output device, the print device being adapted to receive the print cartridge, wherein a first portion of the nozzle tape removably covers substantially all of the outlet portion, wherein a second portion of the nozzle tape removably covers substantially all of the electrical contact portion, and wherein at least one hole through the portion of the nozzle tape covering substantially all of the electrical contact portion is aligned with at least one of the electrical contacts.

15. The analytic apparatus according to claim 14, wherein if the cartridge is loaded into the print device with the nozzle tape covering substantially all of the electrical contact portion, an electrical connection will be established between the at least one electrical contact aligned with the hole in the nozzle tape and a corresponding electrical contact provided in the print device.

16. The analytic apparatus according to claim 15, wherein after the cartridge is loaded into the print device, the nozzle tape is adapted to be removed by removing the cartridge from the print device and pulling on an accessible end of the nozzle tape.

* * * * *

UNITED STATES PATENT AND TRADEMARK OFFICE

CERTIFICATE OF CORRECTION

PATENT NO. : 6,926,397 B2
APPLICATION NO. : 10/424832
DATED : August 9, 2005
INVENTOR(S) : Jefferson P. Ward et al.

It is certified that error appears in the above-identified patent and that said Letters Patent is hereby corrected as shown below:

IN THE CLAIMS

Claim 8, Column 6, line 60, delete "and"

Column 8, line 32, insert the following claims:
--17. An analytical apparatus comprising:
an output device;
a print cartridge comprising:
an electrical contact portion having a plurality of electrical contacts thereon;
an outlet portion adapted to dispense a substance housed within the cartridge; and
a nozzle tape, and
a print device electrically connected to the output device, the print device being adapted to receive the print cartridge,
wherein a first portion of the nozzle tape removably covers substantially all of the outlet portion, wherein a second portion of the nozzle tape removably covers substantially all of the electrical contact portion,
wherein at least one hole through the portion of the nozzle tape covers substantially all of the electrical contact portion is aligned with at least one of the electrical contacts,
wherein if the cartridge is loaded into the print device with the nozzle tape covering substantially all of the electrical contact portion, an electrical connection will be established between the at least one electrical contact aligned with the hole in the nozzle tape and a corresponding electrical contact provided in the print device,
wherein the electrical connection between the electrical contact on the catridge which is aligned with the at least one hole and the corresponding electrical contact provided in the print device is configured in the apparatus to initiate a first electrical signal to the output device, and
wherein the first electrical signal is adapted to indicate that the nozzle tape covers substantially all of the electrical contact portion.

Signed and Sealed this

First Day of June, 2010

David J. Kappos

David J. Kappos
*Director of the United States Patent and Trademark Office*

IN THE CLAIMS

18. The analytic apparatus according to claim 17, wherein in response to the first signal, the nozzle tape is adapted to be removed by removing the cartridge from the print device and pulling on an accessible end of the nozzle tape, wherein after the nozzle tape is removed additional electrical connections will be established between at least some of the remaining electrical contacts on the print cartridge and corresponding electrical contacts provided in the print device, and wherein the additional electrical connections are adapted to send additional electrical signals to the output device.

19. The analytical apparatus according to claim 18, wherein at least one of the additional electrical signals indicates that the nozzle tape does not cover substantially all of the electrical contact portion.

20. The analytical apparatus according to claim 14, wherein the substance is ink or toner.

21. The analytical apparatus according to claim 14, wherein the output device is a computer or is a part of the print device.--

UNITED STATES PATENT AND TRADEMARK OFFICE

CERTIFICATE OF CORRECTION

PATENT NO. : 6,926,397 B2
APPLICATION NO. : 10/424832
DATED : August 9, 2005
INVENTOR(S) : Jefferson P. Ward et al.

It is certified that error appears in the above-identified patent and that said Letters Patent is hereby corrected as shown below:

Delete the title page and substitute therefore the attached title page showing corrected number of claims in patent.

IN THE CLAIMS

Claim 8, Column 6, line 60, delete "and".

Column 8, line 32, insert the following claims:
--17. An analytical apparatus comprising:
an output device;
a print cartridge comprising:
an electrical contact portion having a plurality of electrical contacts thereon;
an outlet portion adapted to dispense a substance housed within the cartridge; and
a nozzle tape, and
a print device electrically connected to the output device, the print device being adapted to receive the print cartridge,
wherein a first portion of the nozzle tape removably covers substantially all of the outlet portion, wherein a second portion of the nozzle tape removably covers substantially all of the electrical contact portion,
wherein at least one hole through the portion of the nozzle tape covers substantially all of the electrical contact portion is aligned with at least one of the electrical contacts,
wherein if the cartridge is loaded into the print device with the nozzle tape covering substantially all of the electrical contact portion, an electrical connection will be established between the at least one electrical contact aligned with the hole in the nozzle tape and a corresponding electrical contact provided in the print device,
wherein the electrical connection between the electrical contact on the cartridge which is aligned with the at least one hole and the corresponding electrical contact provided in the print device is configured in the apparatus to initiate a first electrical signal to the output device, and This certificate supersedes the Certificate of Correction issued June 1, 2010.

Signed and Sealed this

Twenty-ninth Day of June, 2010

David J. Kappos

David J. Kappos
*Director of the United States Patent and Trademark Office*

IN THE CLAIMS wherein the first electrical signal is adapted to indicate that the nozzle tape covers substantially all of the electrical contact portion.

18. The analytic apparatus according to claim 17, wherein in response to the first signal, the nozzle tape is adapted to be removed by removing the cartridge from the print device and pulling on an accessible end of the nozzle tape, wherein after the nozzle tape is removed additional electrical connections will be established between at least some of the remaining electrical contacts on the print cartridge and corresponding electrical contacts provided in the print device, and wherein the additional electrical connections are adapted to send additional electrical signals to the output device.

19. The analytical apparatus according to claim 18, wherein at least one of the additional electrical signals indicates that the nozzle tape does not cover substantially all of the electrical contact portion.

20. The analytical apparatus according to claim 14, wherein the substance is ink or toner.

21. The analytical apparatus according to claim 14, wherein the output device is a computer or is a part of the print device.--.

(12) United States Patent
Ward et al.

(10) Patent No.: US 6,926,397 B2
(45) Date of Patent: Aug. 9, 2005

(54) CARTRIDGE TAPE REMOVAL APPARATUS AND METHOD

(75) Inventors: Jefferson P Ward, Brush Prairie, WA (US); Erik D Ness, Vancouver, WA (US); Teresa M Cray, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 90 days.

(21) Appl. No.: 10/424,832

(22) Filed: Apr. 29, 2003

(65) Prior Publication Data

US 2004/0218023 A1 Nov. 4, 2004

(51) Int. Cl.[7] ..... B41J 2/175
(52) U.S. Cl. ..... 347/86
(58) Field of Search ..... 347/86, 84, 85, 347/87, 100, 47, 50, 29, 22, 44

(56) References Cited

U.S. PATENT DOCUMENTS 5,414,454 A * 5/1995 Reid ..... 347/29
5,966,156 A * 10/1999 Scheffelin et al. ..... 347/86
6,161,915 A 12/2000 Bolash et al.
6,260,942 B1 7/2001 Ahne et al.
6,634,732 B2 * 10/2003 Farr et al. ..... 347/29

* cited by examiner

*Primary Examiner*—K. Feggins

(57) ABSTRACT

A nozzle tape covers substantially all of an outlet portion and an electrical contact portion of a print cartridge. At least one hole provided in the portion of the nozzle tape covering substantially all of the electrical contact portion exposes at least one electrical contact formed on the electrical contact portion. When the cartridge is installed in a print device, such as a printer, a partial electrical connection will be established between the exposed electrical contact and a corresponding electrical contact in the print device. The partial electrical connection may be used to convey a signal to an output device, such as a computer. The signal may indicate that the nozzle tape must be removed before the print cartridge will work properly.

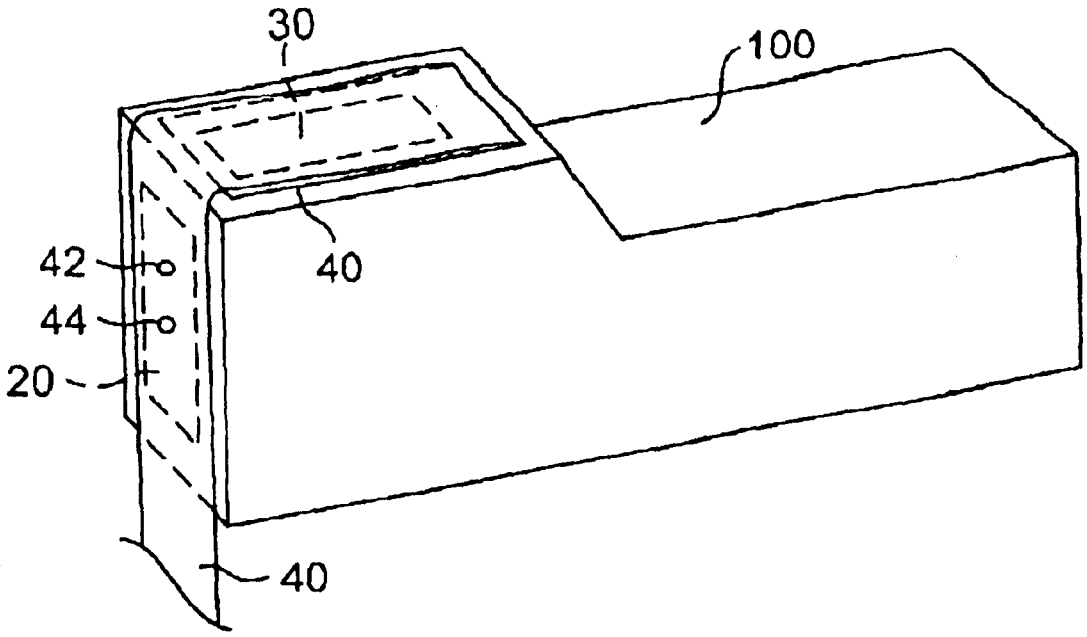

21 Claims, 6 Drawing Sheets